United States Patent [19]

Wills

[11] Patent Number: 4,922,849

[45] Date of Patent: May 8, 1990

[54] BOW COVER

[76] Inventor: James H. Wills, 895 90th Ave. N.W., Coon Rapids, Minn. 55433

[21] Appl. No.: 272,500

[22] Filed: Nov. 17, 1988

[51] Int. Cl.[5] ..... B63B 17/00

[52] U.S. Cl. ..... 114/361; 114/201 R

[58] Field of Search ..... 114/361, 364, 343, 349, 114/14, 78, 85, 201 R, 203, 71; 441/38; D12/300, 315, 317, 318

[56] References Cited

U.S. PATENT DOCUMENTS

| | | | |
|---|---|---|---|
| 2,764,765 | 10/1956 | Woodruff | 114/361 |
| 3,475,773 | 11/1969 | Rodman | 114/361 |
| 3,734,047 | 5/1973 | Burton | 114/361 |
| 3,831,208 | 8/1974 | Smith | 114/361 |
| 3,834,340 | 9/1974 | Thorpe | 220/18 |
| 4,092,754 | 6/1978 | Yost | 114/361 |
| 4,223,414 | 9/1980 | Dickson | 114/361 |

*Primary Examiner*—Sherman D. Basinger
*Assistant Examiner*—Clifford T. Bartz
*Attorney, Agent, or Firm*—Kinney & Lange

[57] ABSTRACT

A bow cover for covering an open portion of the bow in an open-bow boat having a raised interior portion and a flared portion therearound with an inwardly directed opening through each, a cover arrangement being fastenable to the interior portion and extending over the passageway to the bow of the boat.

10 Claims, 7 Drawing Sheets

BOW COVER

BACKGROUND OF THE INVENTION

The present invention relates to covers for use over the bow of open-bow boats and, more particularly, to covers which can be positioned over the open portion of said bows, but which can also be removed therefrom without great effort.

Pleasure boating has been and is a major recreational activity. Many kinds of boats have been developed to meet the demand for various kinds of recreational boating. Among these is the open-bow power boat.

In a powered runabout boat, or speedboat, there is usually provided an operating station toward the forward part of the boat where the steering wheel through a console, throttle and starter controls are located. Typically, a windshield is provided just ahead of this station mounted above the console on a support of some sort. While many boats have a full deck over the bow portion of the boat from just beyond the windshield to the prow of the boat, a particularly attractive arrangement is to provide an open area often with seats in this bow portion in front of the windshield. Accommodating such an arrangement, the divider panels, which support the console and separate the bow portion from the remaining portions of the boat, have a passageway therethrough. In addition, the windshield is provided in sections one of which can be opened by being swung on a hinge by which it is attached to another windshield section to thereby permit access to the bow portion of the boat.

Such an arrangement provides additional seating, and provides, either alternatively or supplementally, additional storage capacity which is accessible far more conveniently than would be the case with a solid deck over the bow.

However, the open-bow boat also has some shortcomings. In rough weather, waves can break across the bow inundating any items stored at that location. Further, the value of items stored must be small, or someone must continually watch them, since there is no secure space in the boat for storing items of significant value. Further, there is little privacy in such a boat. Thus, there is a desire to retain the advantages of an open-bow boat but permit, when needed, secure storage, protection from the weather and water, and privacy.

SUMMARY OF THE INVENTION

The present invention provides a bow cover for covering an open portion of the bow in an open-bow boat. The bow cover comprises a shell having an interior portion and a flared portion therearound with an inwardly directed opening through both. The outer edge of the flared portion matches the rim deck of the boat as supported by the hull and by the divider separating the bow portion from remaining portions of the boat. Attachment means can be used under the bow cover to fasten it to interior sides of the bow portion of the boat. A cover arrangement can be fastened to the shell to cover the inwardly directed opening in both the interior portion and the flared portion, and to extend past the flared portion over the passageway to the open bow portion. This covering arrangement has a separable portion which can block the bow portion passageway to prevent ingress and egress from that portion of the boat.

DETAILED DESCRIPTION OF THE PREFERRED EMBODIMENTS

Figure 1:
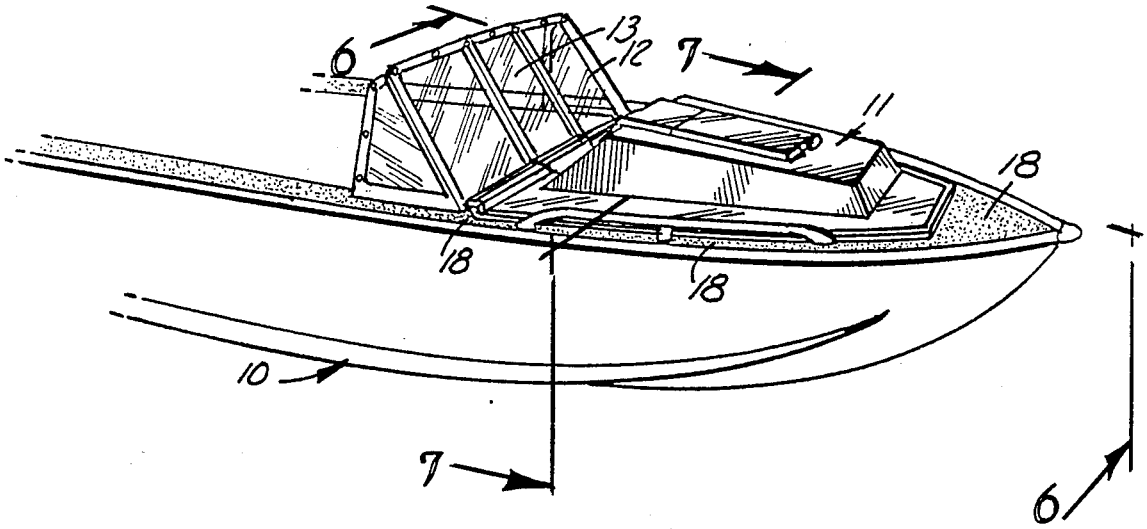
FIG. 1 shows a bow portion of an open-bow boat having a bow cover thereover embodying the present invention.

FIG. 1 shows a bow portion of an open-bow boat, 10, the open portion thereof being underneath a bow cover, 11. The boat has a windshield, 12, with a center portion, 13, which is hinged to one of the windshield portions on either side thereof so that it can be swung to that side to provide a passageway therethrough.

Figure 2A:
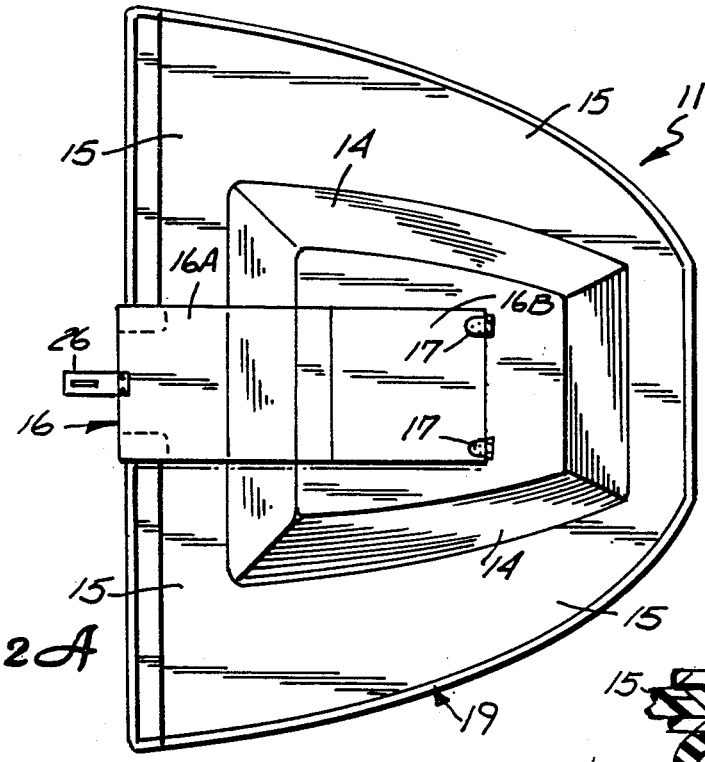
FIGS. 2A and 2B show alternative top views of such a bow cover.

FIG. 2A shows a top view of bow cover 11. Bow cover 11 has a raised interior portion, 14, surrounded for the most part by a flared outer portion, 15. There is an opening, 11', through flared portion 15 which extends into raised portion 14 that is covered in FIG. 2A by a covering arrangement, 16, but can be seen in FIG. 2B. A pair of hinges, 17, attach covering arrangement 16 to raised portion 14 of bow cover 11.

Figure 2B:
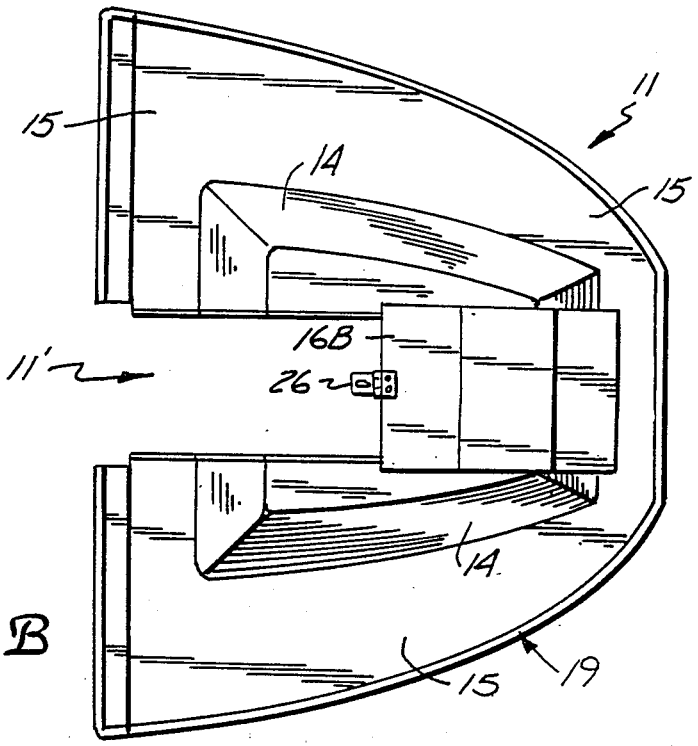

As indicated above, inward opening 11' can be more clearly seen in FIG. 2B where covering arrangement 16 has been opened. As can be seen, covering arrangement 16 has a first part 16A that is connected by hinges 17 to raise portion 14 of bow cover 11. A second portion, 16B, is shown which is hinged to portion 16A of covering arrangement 16. Note that inwardly directed opening 11' is aligned with middle portion 13 of windshield 12 if bow cover 11 is symmetrically positioned on that rim deck, 18, surrounding the opening in the bow portion of boat 10 in FIG. 1. The dashed lines on second portion 16B in FIG. 2A show that such portion may be narrowed at the end if middle portion 13 is narrower than the widest extent of that portion. Rim deck 18 is supported by the hull of boat 10 and by the console support dividers. Thus, one can pass directly into the bow portion of boat 10 from the remaining portions of the boat through the passageway in the console divider support panel and the open portion of windshield 12 where section 13 has swung open. One can then proceed directly into raised portion 14 without having to stoop under flared portion 15.

Figure 3:
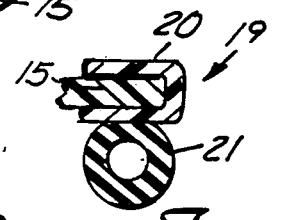
FIG. 3 shows a fragmentary view of a portion of such a bow cover.

FIGS. 2A and 2B each show a gasket arrangement, 19, provided about the outer edge of flared portion 15. This gasket is shown in greater detail in FIG. 3, where a U-shaped gripping portion, 20, thereof is shown slipped over the outer edge of flared portion 15. Attached to gripping portion 20 is a flexible, water resistant sealing tube, 21. Gasket arrangement 19 is around the entire outer edge of flared portion 15 except where inwardly directed opening 11' occurs. Thus, sealing tube 21 is against rim deck 18 of boat 10 in FIG. 1, including the portion of that rim deck 18 supported by the structure supporting windshield 12.

However, gasket arrangement 19 can be omitted altogether if flared portions 15 follows the exposed surface of rim deck 18 sufficiently well. In this instance, holding arrangements, placed inside bow cover 11 to hold it to the inside of boat 10, to be described below, can exert considerable force on bow cover 11 pulling it toward the exposed surface of rim deck 18 and boat 10. Flared portion 15, if made sufficiently flexible with respect to raised portion 14, can be subjected to such a pull force by the holding arrangements that flared portion 15 can be pulled into place all along the exposed surface of rim deck 18.

In many situations, this pulling into place will be sufficient closure over this open bow space in the bow portion of boat 10 so that a gasket arrangement can be dispensed with. In other situations, or when a safety margin for waterproofing is desired, gasket arrangement 19 can be used on the outer edge of flared portion 15 whether that portion is designed to flex with respect to raised portion 14 or not. Typically, a similar gasket arrangement will be used on the edges of covering arrangement 16 in both parts 16A and 16B to provide a seal over opening 11'.

Figure 4:
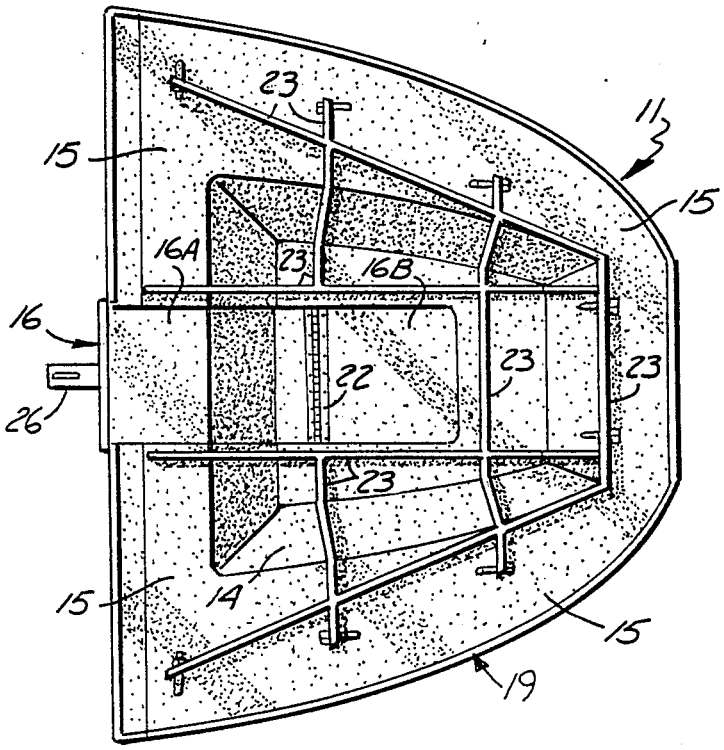
FIG. 4 shows a bottom view of such a bow cover.

FIG. 4 shows a bottom view of bow cover 11 where there is an unfinished surface which is substantially concave in its major shape features with flared portion 15 being at an oblique angle with respect to raised interior portion 14, or not more than perpendicular thereto. Of course, this interior surface could be finished if so desired. The material for bow cover 11 would typically be fiberglass, and methods of yielding a finished surface thereon are well known. The top surface of bow cover 11 is such a finished surface.

Covering arrangement 16 has a hinge, 22, shown in FIG. 4 joining portions 16A and 16B thereof together. As can be seen, a series of support structures or ribs, 23, are provided underneath bow cover 11 to give it rigidity and substantial support, particularly at raised interior portion 14. These ribs permit one to walk on bow cover 12 when mounted on a boat without there being undue flexing of the fiberglass shell of which it is formed.

Figure 5:
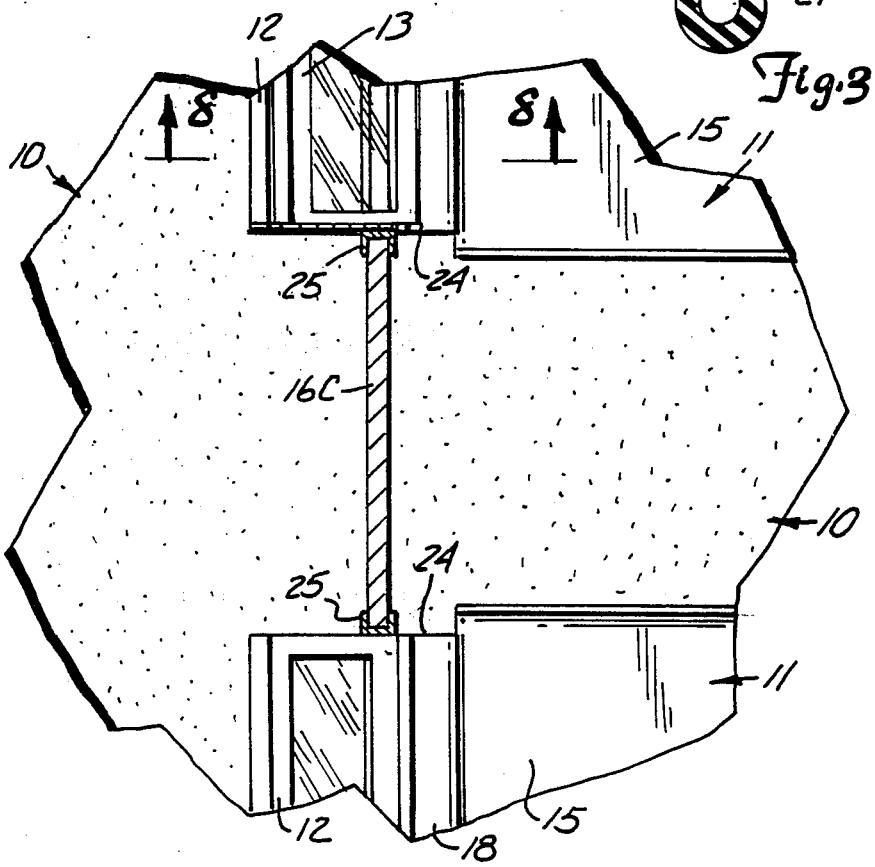
FIG. 5 shows a fragmentary view, partially in cross section, of a portion of a passageway block connectable to such a bow cover.

FIG. 5 shows a fragmentary view of boat 10 with bow cover 11 in a top view thereof, and with covering arrangement 16 thrown open to the right. The fragment is taken from the portion of boat 10 where the windshields occur adjacent to bow cover 11. Windshield 12, including center portion 13 swung open, are supported on that console divider support panel, 24, supporting that part of rim deck 18 surrounding the open bow space in the bow portion of boat 10. Thus, divider panel 24 separates the bow portion of boat 10 from the remaining portions of the boat as indicated above. Thus, the opening between console divider support panel 24 serves as a passageway from the other portions of boat 10 into the open bow space in the bow portion of boat 10. Convenient passage from the other portions of boat 10 on the left of divider 24 into the bow space in the bow portion of boat 10 on the right also, as indicated above, requires swinging windshield portion 13 open on its hinges.

There is shown in FIG. 5 a cross section view of a further covering arrangement portion, 16C, which is positioned across this passageway in a pair of channel beams, 25. Portion 16C is shown slid down the slots in channel beams 25 to block the passageway from the remaining portion of boat 10 on the left to the open bow space in the bow portion on the right. Closing off this passageway, and swinging the remaining portions of covering arrangement 16 for opening 11' down to cover that opening, secures the open space in the bow portion of boat 10 from the remaining portions of the boat, and from outside the boat. Access to such secured space can be controlled to just those with keys by use of a locked hasp and staple arrangement provided on covering arrangement portions 16B and 16C. Hasp, 26, is shown in FIGS. 2A, 2B and 4 in those figures already described. Thus, when covering arrangement portions 16B and 16C are locked together using hasp 26, access to the bow space in the bow portion of boat 10 is denied to any without a key for the lock since the holding arrangements for bow cover 11 are inside and underneath that cover if mounted on the exposed surface of rim deck 18 of boat 10.

Figure 6:
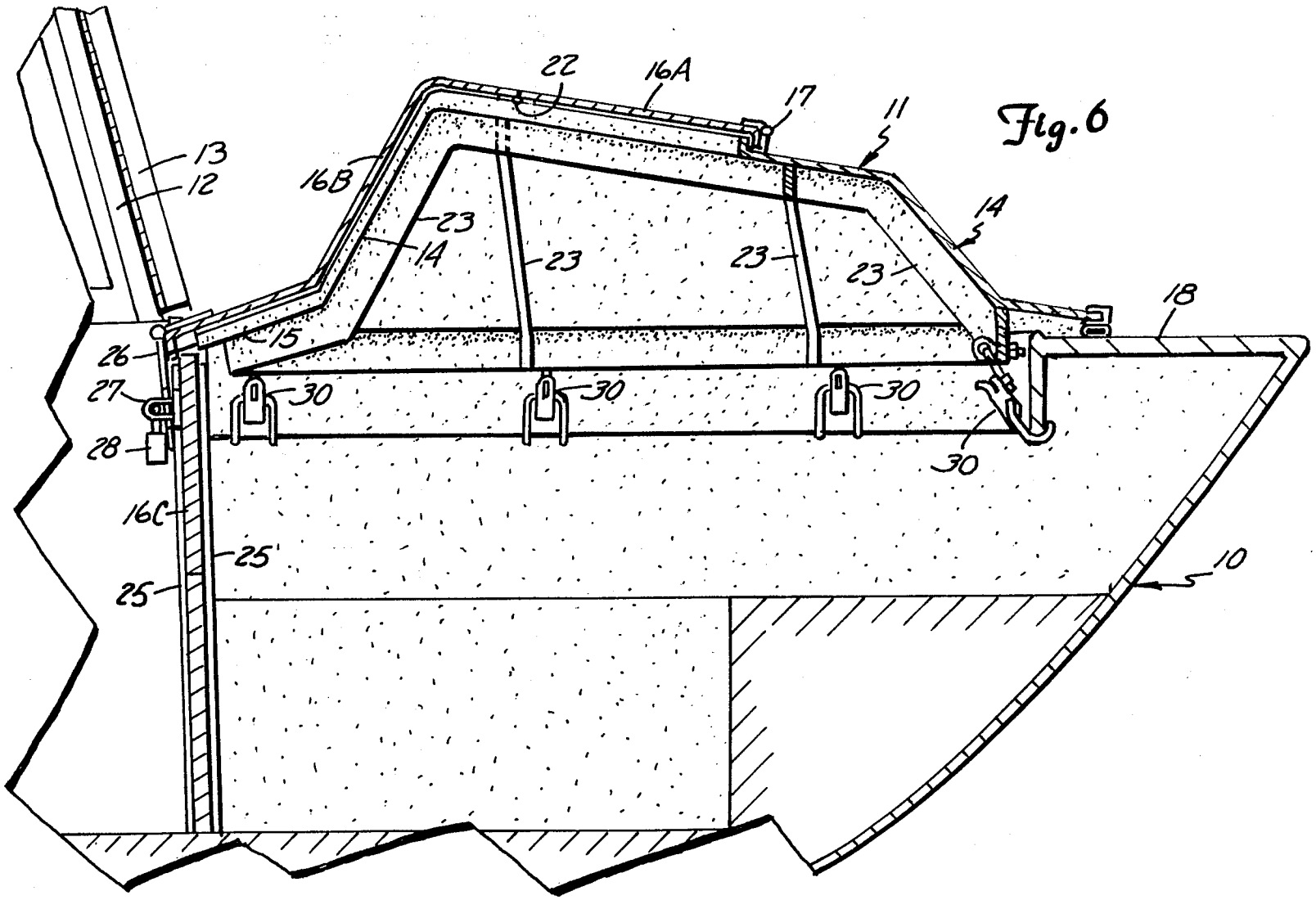
FIG. 6 is a cross section view of a portion of FIG. 1.

This can be more clearly seen in the longitudinal cross section view taken in FIG. 1, and shown in FIG. 6. There, hasp 26 is shown over a staple, 27, with a lock, 28, shown between the U-shaped portion of staple 27 and hasp 26. Hasp 26, staple 27 and lock 28 thus permit cover arrangement 16 section 16B to be connected to and disconnected from covering arrangement portion 16C. Note that section 16B extends out past flared portion 15 over the passageway, over channels 25, and over section 16C.

Figure 7:
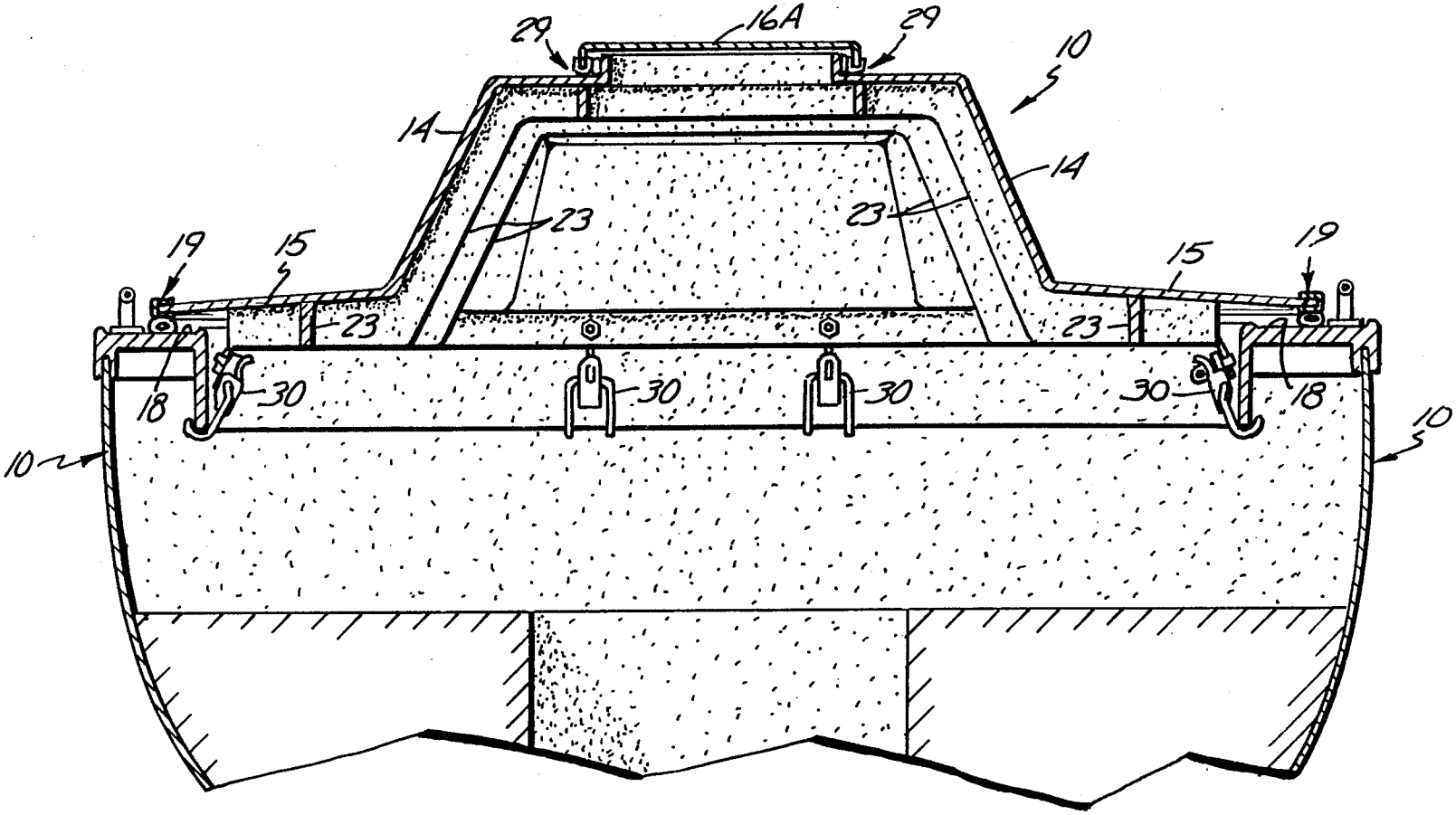
FIG. 7 is another cross section view of a portion of FIG. 1.

FIG. 7 shows a transverse cross section view of the boat and bow cover shown in FIG. 1. There, a further gasket arrangement, 29, is shown on either side of that cover arrangement 16 section shown, section 16A.

Figure 8:
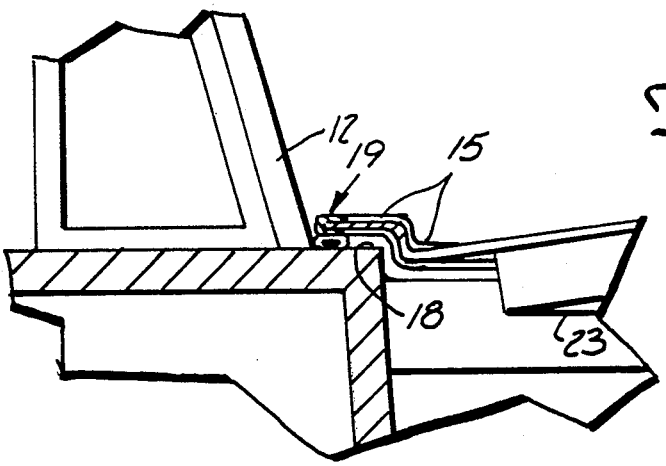
FIG. 8 shows a fragmentary cross section view of a portion FIG. 5.
Figure 9:
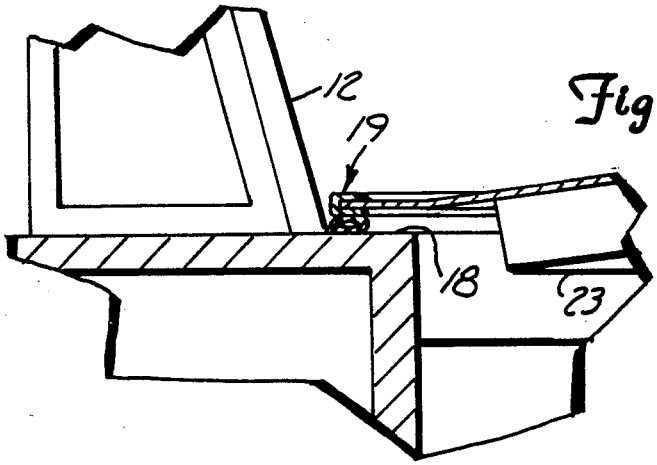
FIG. 9 shows an alternative fragmentary cross section view of a portion of FIG. 5.

FIG. 8 and FIG. 9 show alternative arrangements for the end of flared portion 15 on that portion of rim deck 18 adjacent windshield 12. As can be seen in FIG. 8, there may be a molded portion at the end of flared portion 15 which is conformed to the exposed surface of rim deck 18 and the edge therebelow. On the other hand, in FIG. 9, flared portion 15 comes straight out along the contour followed in the rest of flared portion 15 to rest on rim surface 18.

Figure 13:
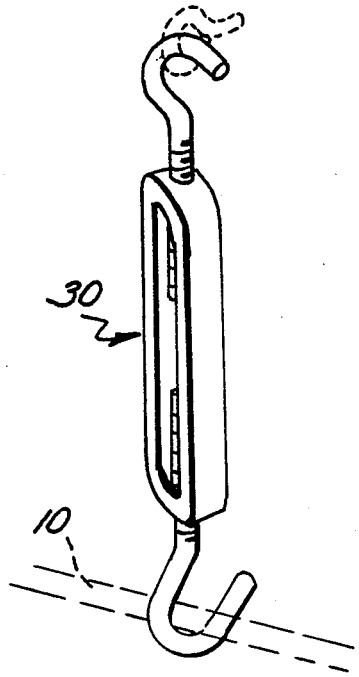
FIG. 13 shows an alternative to the holding arrangement of FIGS. 10 and 11.
Figure 10:
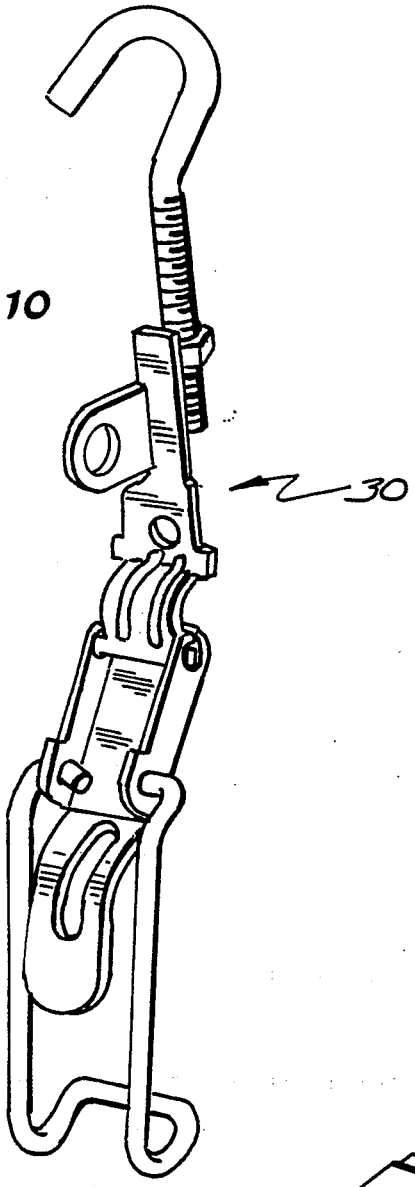
FIG. 10 is a view of a holding arrangement used in the present invention.
Figure 11:
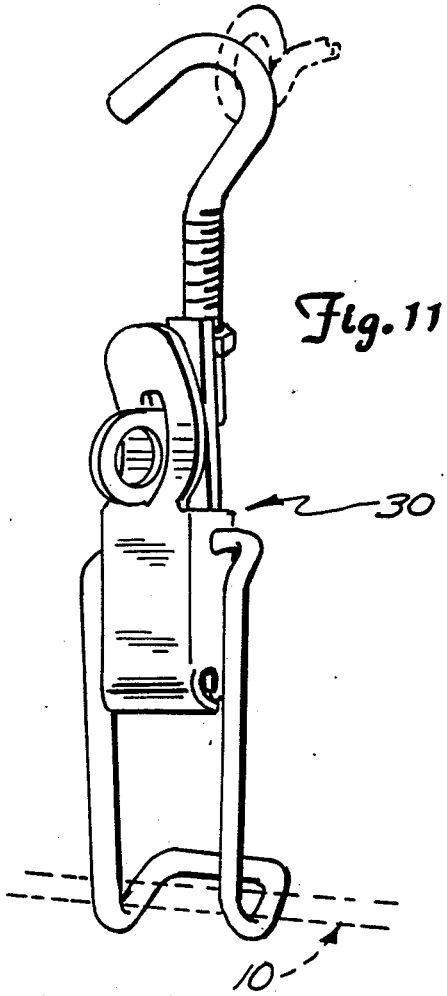
FIG. 11 is an alternative view of that same holding arrangement.
Figure 12:
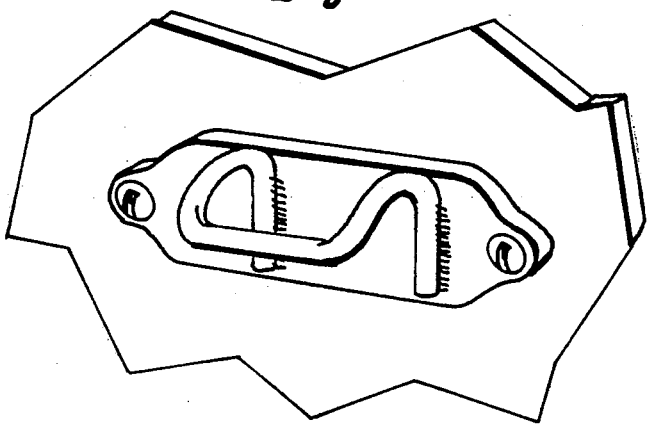
FIG. 12 is an alternative to use with the arrangements of FIGS. 10 and 11.

Returning to FIGS. 6 and 7, holding buckles, 30, are shown used to attach bow cover 11 to boat 10 by buckling between an eye anchored in the shell of bow cover 11 and the underside of an edge in boat 10 below rim deck 18 in boat 10. Holding mechanism 30 is shown in FIG. 10. As can be seen, this is an over-the-center buckle arrangement connected to a threaded hook to permit adjustment. The open position for the buckle arrangement is shown in FIG. 10, and the closed position therefor is shown in FIG. 11. In the absence of a ledge in boat 10, FIG. 12 shows a bracket which can be provided on an inside boat surface as an alternative. FIG. 13 shows an alternative holding arrangement 30, this being a turnbuckle. The over-the-center buckle is much quicker to use in engaging or disengaging bow cover 11 with boat 10.

Although the present invention has been described with reference to preferred embodiments, workers skilled in the art will recognize that changes may be made in form and detail without departing from the spirit and scope of the invention.

What is claimed is:

1. A bow cover for covering an open region within a hull of a boat at its bow which boat has a divider means supported by said hull separating its bow portion from remaining portions of said boat with a passageway therethrough such that said bow portion of said boat is accessible from said remaining portions thereof through said passageway, and where said open region in said bow portion has about a substantial part of its periphery, excluding at least that at said passageway, a rim means supported in said boat such that said rim means has a surface thereof exposed, said bow cover comprising:

a shell means having an inwardly directed opening extending substantially inward therein and having an outer edge substantially all of which is capable of being placed adjacent to said exposed surface of said rim means excluding at said passageway where said inwardly directed opening would be located;

an access means fastenable to said shell means at a point substantially interior to said outer edge thereof such that it can cover said inwardly directed opening and can extend past said shell means such that if said outer edge of said shell means is placed adjacent to said exposed surface of said rim means with said inwardly directed opening aligned with said passageway, as aforesaid, said access means can extend over said passageway; and attachment means connected to said shell means at said interior surface thereof and capable of forming at least a portion of an attachment device.

2. A bow cover for covering an open region with a hull of a boat at its bow which boat has a divider means supported by said hull separating its bow portion from remaining portions of said boat with a passageway therethrough such that said bow portion of said boat is accessible from said remaining portions thereof through said passageway, and where said open region in said bow portion has about a substantial part of its periphery, excluding at least that at said passageway, a rim means supported in said boat such that said rim means has a surface thereof exposed, said bow cover comprising:

a shell means having an interior portion flexibly joined with and substantially surrounded by a flared portion except at an inwardly directed opening extending through said flared portion and into said interior portion with said shell means having a substantially concave interior surface, said flared portion having an outer edge substantially all which is capable of being placed adjacent to said exposed surface of said rim means excluding its said passageway where said inwardly directed opening would be located;

an access means fastenable to said shell means to cover said inwardly directed opening in both said interior portion and said flared portion and to extend past said flared portion such that if said flared portion outer edge is placed adjacent to said exposed surface of said rim means with said inwardly directed opening aligned with said passageway, as aforesaid, said access means can extend over said passageway; and attachment means connected to said shell means at said interior surface thereof and capable of forming at least a portion of an attachment device.

3. The apparatus of claim 2 wherein there is a substantial angle between a junction of said interior surface of said shell means at said interior portion thereof and said interior surface of said shell means at said flared portion thereof.

4. The apparatus of claim 2 wherein said flared portion has a gasket provided adjacent to said outer edge thereof.

5. The apparatus of claim 1 wherein said access means has a first part rotatably fastened to said interior portion of said shell means adjacent said inwardly directed opening, and a second part which is rotatably connected to said first part.

6. The apparatus of claim 1 wherein said attachment means can form at least part of a closed structural loop with some remaining portions of said bow cover that are not said attachment means and with some portions of said rim means if said bow cover is appropriately positioned on said rim means.

7. The apparatus of claim 1 wherein each of said attachment means is a holding means capable of gripping a portion of said boat.

8. The apparatus of claim 5 wherein said access means has a third part separable from said second part, said third part being capable of extending across said passageway to block ingress and egress from said bow portion.

9. The apparatus of claim 2 wherein said attachment means can form at least part of a closed structural loop with some remaining portions of said bow cover that are not said attachment means and with some portions of said rim means if said bow cover is appropriately positioned on said rim means.

10. The apparatus of claim 2 wherein each of said attachment means is a holding means capable of gripping a portion of said boat.

* * * * *

UNITED STATES PATENT AND TRADEMARK OFFICE

CERTIFICATE OF CORRECTION

PATENT NO. : 4,922,849

DATED : May 8, 1990

INVENTOR(S) : James H. Wills

It is certified that error appears in the above-identified patent and that said Letters Patent is hereby corrected as shown below:

On the title page item [56]:

In the Reference Cited Section, under U.S. PATENT DOCUMENTS, insert the following:

| | | | |
|---|---|---|---|
| 3,019,758 | 2/1962 | Erkert | 114/219 |
| 3,052,896 | 9/1962 | Beach | 9/1 |
| 4,293,967 | 10/1981 | Ord | 9/1.6 |
| 4,627,373 | 12/1986 | Nishida | 114/182 |
| 4,662,303 | 5/1987 | Duff | 114/343 |

Column 5, line 36, delete "with" and insert --within--.

Signed and Sealed this

Seventeenth Day of March, 1992

*Attest:*

*Attesting Officer*

HARRY F. MANBECK, JR.

*Commissioner of Patents and Trademarks*